US008814314B2

(12) United States Patent
Smith et al.

(10) Patent No.: US 8,814,314 B2
(45) Date of Patent: Aug. 26, 2014

(54) METHOD AND APPARATUS FOR CONTROL OF GLOSS LEVEL IN PRINTED IMAGES

(75) Inventors: Richard M. Smith, Gaston, OR (US); Trevor J. Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 97 days.

(21) Appl. No.: 13/594,440

(22) Filed: Aug. 24, 2012

(65) Prior Publication Data

US 2014/0055511 A1 Feb. 27, 2014

(51) Int. Cl.
*B41J 29/38* (2006.01)

(52) U.S. Cl.
USPC ..... 347/16; 347/101; 347/104

(58) Field of Classification Search
USPC ..... 347/9, 14, 16, 102–104, 99, 101, 179, 347/213
See application file for complete search history.

(56) References Cited

U.S. PATENT DOCUMENTS

| | | | | |
|---|---|---|---|---|
| 5,715,507 | A | 2/1998 | Kobayashi et al. | |
| 5,748,221 | A | 5/1998 | Castelli et al. | |
| 5,783,348 | A | 7/1998 | Tyagi et al. | |
| 5,890,032 | A | 3/1999 | Aslam et al. | |
| 6,196,675 | B1 | 3/2001 | Deily et al. | |
| 6,386,697 | B1 | 5/2002 | Yamamoto et al. | |
| 6,494,570 | B1 | 12/2002 | Snyder | |
| 6,561,643 | B1 | 5/2003 | Walker et al. | |
| 6,939,002 | B2 | 9/2005 | Janosky et al. | |
| 7,046,364 | B2 | 5/2006 | Schneider et al. | |
| 7,121,660 | B2 | 10/2006 | Ide et al. | |
| 7,310,493 | B2 | 12/2007 | Roof et al. | |
| 7,576,149 | B2 | 8/2009 | Anderson et al. | |
| 7,661,786 | B2 | 2/2010 | Nakazawa et al. | |
| 7,681,966 | B2 | 3/2010 | Parker et al. | |
| 7,764,893 | B2 | 7/2010 | Banton et al. | |
| 7,934,785 | B2 | 5/2011 | Lang | |
| 8,007,099 | B2 * | 8/2011 | Domoto et al. | 347/103 |
| 8,092,970 | B2 | 1/2012 | Tyagi et al. | |
| 8,152,288 | B2 * | 4/2012 | Williams et al. | 347/88 |
| 8,155,547 | B2 | 4/2012 | Condello et al. | |
| 8,408,689 | B2 * | 4/2013 | Roof et al. | 347/99 |
| 2002/0180819 | A1 | 12/2002 | Faken | |
| 2003/0095171 | A1 | 5/2003 | Kaga et al. | |
| 2003/0099007 | A1 | 5/2003 | Towner et al. | |
| 2003/0148067 | A1 | 8/2003 | Escobedo et al. | |
| 2004/0070658 | A1 | 4/2004 | Janosky et al. | |
| 2004/0179201 | A1 | 9/2004 | Schneider et al. | |
| 2005/0169680 | A1 | 8/2005 | Ng et al. | |
| 2006/0115287 | A1 | 6/2006 | Roof | |
| 2008/0245979 | A1 | 10/2008 | Banton et al. | |
| 2008/0248196 | A1 | 10/2008 | Anderson et al. | |
| 2009/0015849 | A1 | 1/2009 | Jahana et al. | |

(Continued)

OTHER PUBLICATIONS

American Society for Testing and Materials, Standard Test Method for Specular Gloss, Designation: D 523-89, (Reapproved 1999), Annual Book of ASTM Standards, 5 pages, West Conshohocken, PA, USA.

*Primary Examiner* — Juanita D Jackson
(74) *Attorney, Agent, or Firm* — Maginot, Moore & Beck, LLP

(57) ABSTRACT

An inkjet printer is configured to process print media having an ink image differently to alter a gloss level of the ink image on the print media. In one mode of operation, the printer moves print media bearing an ink image on one side only through a transfix nip a second time to reduce a gloss level of the printed image.

12 Claims, 4 Drawing Sheets

(56) References Cited

U.S. PATENT DOCUMENTS

| | | | |
|---|---|---|---|
| 2009/0136681 | A1 | 5/2009 | Belelie et al. |
| 2009/0141110 | A1 | 6/2009 | Gervasi et al. |
| 2009/0169277 | A1 | 7/2009 | Fowlkes et al. |
| 2009/0238616 | A1 | 9/2009 | Ciaschi et al. |
| 2009/0262159 | A1 | 10/2009 | Lang |
| 2010/0209677 | A1 | 8/2010 | Sano et al. |
| 2010/0247795 | A1 | 9/2010 | Heath |
| 2010/0259794 | A1 | 10/2010 | Purdum et al. |
| 2011/0102525 | A1 | 5/2011 | Larson et al. |

* cited by examiner

METHOD AND APPARATUS FOR CONTROL OF GLOSS LEVEL IN PRINTED IMAGES

TECHNICAL FIELD

This document relates to inkjet printing, and, more specifically, to inkjet printers that control a gloss level of images formed during inkjet printing.

BACKGROUND

In general, inkjet printing machines or printers include at least one printhead that ejects drops or jets of liquid ink to produce an ink image on a recording or image forming media. A phase change inkjet printer employs phase change inks that are in the solid phase at ambient temperature, but transition to a liquid phase at an elevated temperature. Inkjets in one or more printheads eject the melted ink either directly onto a print medium or onto an intermediate imaging member and the image is transferred from the intermediate imaging member to the print medium. Once the ejected ink is on the print medium, the ink droplets quickly solidify to form a printed image.

One quality of a printed image is interchangeably referred to a "gloss," "gloss level," or the "glossiness" of the printed image. The glossiness of the printed image refers to how light is reflected from the surface of the printed image. In a printed image with a high gloss level, also referred to as a "glossy" image, a large portion of the light reflected from the printed image reflects in a specular manner. That is, a substantial portion of the light that reflects from the surface of the printed image reflects at an angle that is equivalent to the angle at which the incident light strikes the printed image. More plainly, a high gloss image has a more "mirror like" shine due to the specular reflection of light from the printed image. In a printed image with a low gloss level, also referred to as a "matte" image, a large portion of the light reflecting from the printed image reflects in a diffuse manner. In a diffuse reflection, reflected light leaves the printed image at many different angles instead of primarily reflecting at an angle equivalent to the incident angle of the light that strikes the printed image. More plainly, a matte image, which reflects light diffusely, appears to have less "shine" and can have a "softer" appearance compared to a glossy image.

Printed images with glossy and matte qualities are useful in a wide variety of printed documents. One known advantage of solid ink printers is that the composition of many solid inks produces ink images with a high gloss level without requiring specialized print media, such as glossy paper, and without requiring printer components that are specifically configured to add gloss to printed images. As noted above, however, many printed images are matte images that are produced with a low gloss level. Consequently, improvements to inkjet printers that enable production of printed images over a range of desired gloss levels would be beneficial.

SUMMARY

In one embodiment, a method for controlling a gloss level of a printed image has been developed. The method includes ejecting a plurality of ink drops onto a surface of an imaging member to form an ink image on the imaging member moving a print medium through a nip formed between the imaging member and a transfix member to transfer the ink image from the imaging member onto one side of the print medium, and moving the print medium through the nip after the ink image has been transferred to the print medium to reduce a gloss level of the printed image by engaging the one side of the print medium having the ink image with the transfix member while engaging another side of the print medium without an ink image.

In another embodiment, a method for controlling a gloss level of a duplex printed image has been developed. The method includes selecting an elevated temperature for heating a print medium, the elevated temperature being between a lower predetermined temperature and an upper predetermined temperature, the elevated temperature being selected with reference to a predetermined reduction in a gloss level for a second ink image to be transferred to a second side of the print medium, heating the print medium to the elevated temperature, the print medium having a first ink image formed on a first side of the print medium before the print medium is heated to the elevated temperature, and transferring the second ink image from an imaging member to the second side of the print medium after the print medium is heated to the elevated temperature to reduce the gloss level of the second ink image with the predetermined reduction in gloss level.

In another embodiment, a printer that is configured to control a gloss level of a printed image has been developed. The printer includes a plurality of inkjets configured to eject ink drops onto an imaging member, an actuator operatively connected to the imaging member to rotate the imaging member, a transfix member configured to move into and out of engagement with the imaging member to form a nip, a media path configured to move a print medium through the nip, and a controller operatively connected to the plurality of inkjets, the actuator, and the media path. The controller is configured to operate the actuator to rotate the imaging member, eject a plurality of ink drops onto the imaging member with the plurality of inkjets to form a first ink image on the imaging member, operate the media path to move the print medium through the nip to transfer the first ink image from the imaging member onto a first side of the print medium, and operate the media path to move the print medium through the nip to reduce a gloss level of the first ink image by engaging the first ink image with the transfix member and engaging a second side of the print medium having no ink image with the imaging member.

DETAILED DESCRIPTION

Figure 1:
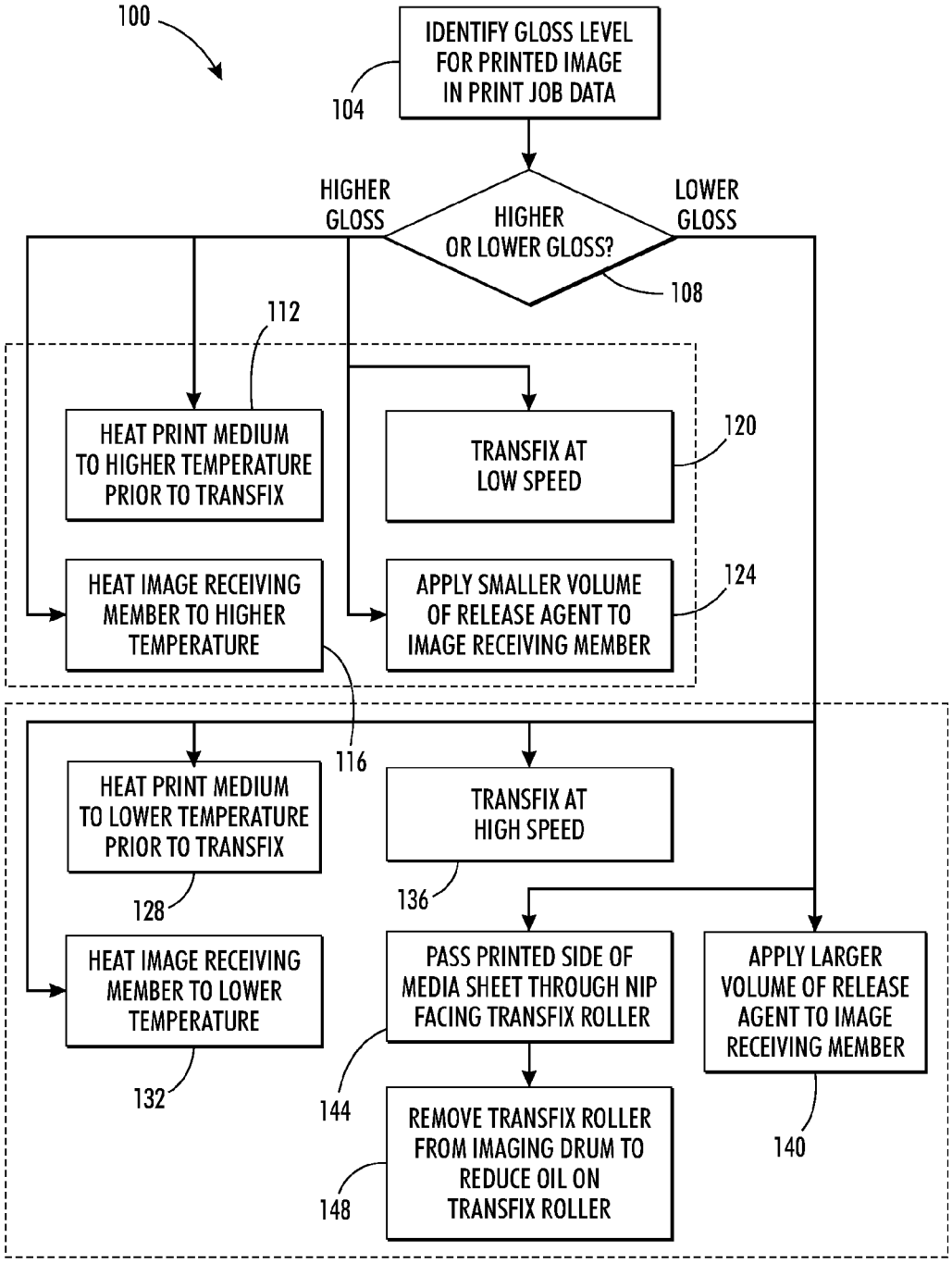
FIG. 1 is a block diagram of a process 100 for operating an inkjet printer to generate printed images with a selected gloss level.

For a general understanding of the present embodiments, reference is made to the drawings. In the drawings, like reference numerals have been used throughout to designate like elements.

As used herein, the term "printer" refers to a device that produces ink images on print media. "Print media" may be a physical sheet of paper, plastic, or other suitable physical print media substrate for images, whether precut or continuous media fed. The printer can include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally includes information in electronic form which is to be rendered into data used to generate signals that operate inkjet ejectors to form an ink image on an image receiving surface and can include text, graphics, pictures, and the like. As used herein, the process direction is the direction in which an image receiving surface, e.g., media sheet or media, or intermediate transfer drum or belt, moves as an ink image is formed on the image receiving surface in the printer. The cross-process direction, along the same plane as the image receiving surface, is substantially perpendicular to the process direction. As used herein, the terms "simplex" and "duplex" refer to print modes that print ink images on a single side or on both sides, respectively, of a two sided print medium.

As used herein, the term "transfixing" refers to an operation in an indirect inkjet printer whereby an ink image formed from a plurality of ink drops is transferred from an intermediate imaging member to a print medium. The transfixing operation transfers the ink drops to one side of the print medium and simultaneously applies heat, pressure, or a combination thereof to permanently fix the ink image to the media sheet.

As used herein, the term "gloss level" refers to a propensity of a printed ink image to reflect light in a specular manner. With a high gloss level, the ink image reflects light in a more specular manner. With a low gloss level, the ink image reflects light in a more diffuse manner. An inkjet printer can produce ink images with a wide range of gloss levels based on the propensity of the ink image to reflect light in a specular or diffuse manner. The term "gloss unit" refers to a numeric scale for measuring the gloss level of an ink image. The gloss level of the ink image is proportional to the number of gloss units measured for light that is reflected from the ink image. For illustrative purposes, this document refers to numeric gloss units (GUs) that are defined in the ASTM D2457 standard entitled "Standard Test Method for Specular Gloss of Plastic Films and Solid Plastics," and published by ASTM International.

Figure 5:
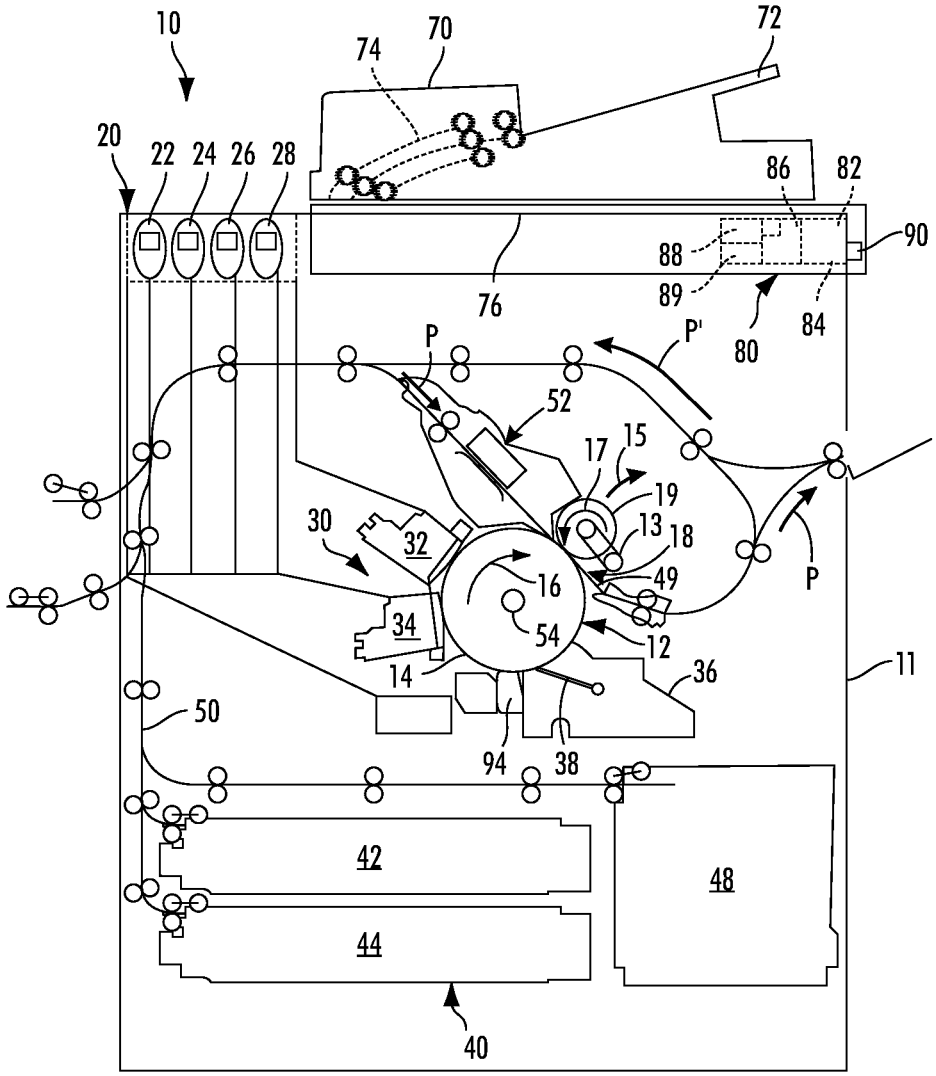
FIG. 5 PRIOR ART
FIG. 5 is a schematic view of a prior art inkjet printer.

FIG. 5 depicts a prior art indirect inkjet printer 10 that is configured to adjust the gloss level of printed ink images. FIG. 5 depicts an embodiment of a prior art printer 10 that can be configured to print ink images with different gloss levels. As illustrated, the printer 10 includes a frame 11 to which is mounted directly or indirectly all its operating subsystems and components, as described below. The phase change ink printer 10 includes an imaging member 12 that is shown in the form of a rotatable imaging drum, but can equally be in the form of a supported endless belt. The imaging member 12 has an image receiving surface 14, which provides a surface for formation of ink images. A heater 54 in the imaging member 12 generates heat to elevate the temperature of the image receiving surface 14 during imaging operations. The imaging member heater 54 is configured with an adjustable output to heat the image receiving surface 14 to a selected temperature. An actuator 94, such as a servo or electric motor, engages the imaging member 12 and is configured to rotate the imaging member 12 in direction 16. In the printer 10, the actuator 94 varies the rotational rate of the imaging member 12 during different printer operations including maintenance operations, image formation operations, and transfixing operations. A transfix roller 19 rotatable in the direction 17 loads against the surface 14 of drum 12 to form a transfix nip 18 within which ink images formed on the surface 14 are transfixed onto a heated print medium 49. A transfix roller position actuator 13 is configured to move the transfix roller 19 into the position depicted in FIG. 5 to form the transfix nip 18, and to move the transfix roller 19 in direction 15 to disengage the transfix nip 18 and imaging member 12.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 5, both of the printhead assemblies 32 and 34 receive the melted CMYK ink from the ink sources 22-28. In another embodiment, the printhead assemblies 32 and 34 are each configured to print a subset of the CMYK ink colors. Alternative printer configurations print a single color of ink or print a different combination of ink colors.

The phase change ink printer 10 includes an imaging drum maintenance unit 36. The maintenance unit includes a reservoir holding a liquid release agent, such as silicone oil, and includes a metering blade 38. The maintenance unit 36 applies a layer of the release agent on the image receiving surface 14 of the rotating imaging member 12 prior to operation of the printhead assemblies 32 and 34 to form ink images on the imaging member 12. The metering blade 38 regulates the volume of release agent on the image receiving surface 14 to form a uniform layer of the release agent for carrying ink drops. The release agent forms a barrier between the image receiving surface 14 and the ink drops in the latent ink image to prevent the ink drops from adhering to the imaging member 12 instead of being transfixed to a print medium.

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

One or both of the media transport 50 and the pre-heater assembly 52 are configured to heat the print medium 49 to one of a range of temperatures before the print medium 49 passes through the transfix nip 18. In one configuration, the thermal output of the pre-heater assembly is adjusted to raise or lower the temperature of the print medium 49. In another configuration, the media transport 50 adjusts the speed of the print medium 49 as the print medium 49 moves past the pre-heater assembly 52 in the process direction P. The increase in temperature of the print medium 49 as the print medium moves past the pre-heater assembly 52 is related to the thermal output of the pre-heater assembly 52 and inversely related to the speed of the media transport 50.

Media sources 42, 44, 48 provide image receiving substrates that pass through media transport path 50 to arrive at transfix nip 18 formed between the imaging member 12 and transfix roller 19 in timed registration with the ink image formed on the image receiving surface 14. As the ink image and media travel through the nip, the ink image is transferred from the surface 14 and fixedly fused to the print medium 49 within the transfix nip 18 in a transfix operation. In a duplexed configuration, the media transport path 50 passes the print medium 49 through the transfix nip 18 a second time for transfixing of a second ink image to a second side of the print medium 49. In the printer 10, the media path 50 moves the print medium in a duplex process direction P' and returns the print medium 49 to the transfix nip with the first side of the print medium 49 carrying the first ink image engaging the transfix roller 19 and the second side of the print medium 49 engaging the imaging member 12. If a second ink image is formed on the image receiving surface 14, then the second ink image is transfixed to the second side of the print medium in a duplex print operation.

Operation and control of the various subsystems, components and functions of the printer 10 are performed with the aid of a controller or electronic subsystem (ESS) 80. The ESS or controller 80, for example, is a self-contained, dedicated minicomputer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data and print job parameters associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead modules 32 and 34 to form ink images, and to control the operations of the printer components and subsystems described herein for controlling the gloss level of printed images. The components in the controller 80 are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 ejects a plurality of ink drops from inkjets in the printhead assemblies 32 and 34 onto the surface 14 of the imaging member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates two dimensional bit maps for each color of ink in the image, such as the CMYK colors.

The printer 10 is an illustrative embodiment of a printer that adjusts the gloss level of printed images using the processes described herein, but the processes described herein can adjust the gloss levels of printed images in alternative inkjet printer configurations. Additionally, while printer 10 is an indirect printer, printers that eject ink drops directly onto a print medium can be operated using the processes described herein.

FIG. 1 depicts a process 100 for selecting a gloss level of a printed image in an inkjet printer. In the discussion below, a reference to the process 100 performing a function or action refers to a controller executing programmed instructions stored in a memory to operate one or more components of the printer to perform the function or action. Process 100 is described in conjunction with the printer 10 for illustrative purposes. In the printer 10 the controller 80 executes programmed instructions stored in the memory 84 to process print job data and control the subsystems in the printer 10 to generate printed images with different gloss levels.

Process 100 begins by identifying a gloss level for a printed image in print job data (block 104). In the printer 10, the print job data include one or more parameters that specify a desired gloss level of a printed image. The print job data can include a parameter that specifies a numeric gloss level for the printed image, or the printer 10 can identify a gloss level indirectly with reference to one or more print job parameters. In one configuration, if print job data indicate that an ink image is predominantly black and white text, then the printer 10 identifies a low gloss level associated with the text, while the printer 10 identifies a high gloss level if the print job data indicate the image is a full color photograph.

In process 100, the printer 10 adjusts the operation of one or more components during the printing operation to generate an ink image with the identified gloss level. A number of individual operations generate ink images with increased or decreased gloss levels. The operations described below can be performed individually or in combination to generate ink images with a desired gloss level. Additionally, the process 100 can perform some operations that increase the gloss level of the printed image and other operations that decrease the gloss level of the printed image to generate ink images with a range of intermediate gloss levels.

Based on the identified gloss level, process 100 can generate printed images with a high gloss level (block 108). In the printer 10, process 100 generates ink images with increased gloss levels by heating the print medium 49 to a higher temperature prior to transfixing the ink image (block 112), heating the imaging member to a higher temperature (block 116), transfixing the ink image to the media sheet at a low speed (block 120), and applying a comparatively smaller volume of release agent to the imaging member during a transfixing operation (block 124).

In the processing described with reference to block 112, the printer 10 activates the pre-heater assembly 52 to heat the print medium 49 to an elevated temperature before the print medium 49 passes through the transfix nip 18. The elevated temperature of the print medium enables phase-change ink that is transfixed from the imaging member 12 onto the print medium 49 to remain liquid for a longer time. The elevated temperature enables the liquid ink to spread and form a more uniform surface that reflects light in a specular manner, resulting in an increased gloss level of the printed image. In the embodiment of printer 10, the elevated temperature of the print medium is approximately 65° C.

In the processing described with reference to block 116, the printer 10 activates the imaging member heater 54 to heat the image receiving surface 14 to an elevated temperature prior to forming an ink image on the image receiving surface 14. The elevated temperature of the imaging member 12 also elevates the temperature of liquid ink drops that are ejected onto the image receiving surface 14. The higher temperature ink drops spread more evenly on the print medium 49 during the transfix process and form a more uniform surface that reflects light in a specular manner, resulting in an increased gloss level of the printed image. In the embodiment of printer 10, the image receiving surface 14 is heated to approximately 58° C. in a high gloss print mode. Both the heating of the print medium 49 described above and the heating of the imaging receiving surface 14 enable the phase change ink to remain in a liquid phase for a longer period of time during and after the transfixing process to enable the liquid ink to solidify with a smoother surface and higher gloss level.

In the processing described with reference to block 120, the printer 10 rotates the imaging member 12 at a lower rate as the print medium 49 passes through the transfix nip 18 to transfer the ink image onto the print medium 49 with a higher gloss level. In the printer 10, the linear speed of the image receiving surface 14 is approximately 5 inches per second (IPS) as the print medium 49 passes through the transfix nip 18. At a lower transfixing speed, the print medium 49 spends comparatively more time in the transfix nip 18. The increased time in the transfix nip 18 enables the transfix roller 17 and the imaging member 12 to apply pressure and heat to the ink image on the print medium for a longer period of time, producing a smoother surface of the ink image that reflects light in a specular manner and has a higher gloss level.

In the processing described with reference to block 124, the printer 10 applies a comparatively smaller volume of release agent to the image receiving surface 14. The maintenance unit 36 applies release agent from an internal reservoir to the imaging member 12 to prevent ink drops from the printhead units 32 and 34 from adhering to the image receiving surface 14 instead of transferring to the print medium 49. The metering blade 38 in the maintenance unit 36 engages the imaging member 12 to regulate the volume of release agent that is applied to the imaging drum. The metering blade 38 wipes excess release agent from the image receiving surface 14 to produce a uniform layer of release agent on the imaging member 12.

Over the operating life of the maintenance unit 36, the metering blade 38 experiences mechanical wear. The worn metering blade 38 removes less of the excess release agent from the image receiving surface 14 than a new metering blade. Consequently, the volume of oil that is transferred to the imaging member during each maintenance operation increases during the operational life of the maintenance unit 36.

Figure 2:
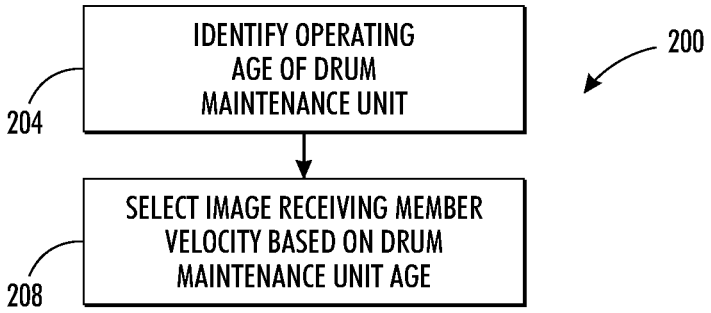
FIG. 2 is a block diagram of a process 200 for controlling a volume of release agent applied to an imaging member to control a gloss level of a printed image.

FIG. 2 depicts a process 200 for control of the printer 10 to compensate for wear on the metering blade 38 and control the volume of release agent that is applied to the image receiving surface 14. In the discussion below, a reference to the process 200 performing a function or action refers to a controller executing programmed instructions stored in a memory to operate one or more components of the printer to perform the function or action. In the printer 10, the controller 80 executes programmed instructions stored in the memory 84 to adjust the volume of release agent applied to the imaging member 12. In process 200, the printer 10 identifies the operating age of the drum maintenance unit (block 204). In one embodiment, the controller 80 stores an operational age value of the maintenance unit 36 in the memory 84. The controller 80 increments the operational age value with reference to an operating parameter of the imaging member or the maintenance unit such as the number of images printed or the number of times that the metering blade 38 engages the imaging member 12 during operation. If the maintenance unit 36 is replaced, the controller 80 resets the operational age value and monitor the operational age of the new maintenance unit.

The printer 10 controls the volume of release agent that is applied to the imaging member 12 by adjusting a rotational velocity of the imaging member 12 when the maintenance system 36 applies release agent to the imaging member 12 with reference to the identified age of the metering blade 12 (block 208). The volume of release agent that is applied to the imaging member 12 increases as the rotational velocity of the imaging member 12 increases. The controller 80 adjusts the rotational velocity of the imaging member to apply the release agent to the imaging member based on the identified gloss level of the printed image. In the printer 10, the image receiving surface 14 moves at linear velocity of approximately 10 IPS in a high gloss operating mode for a new metering blade and gradually reduces the linear velocity of the image receiving surface to X IPS as the metering blade 38 wears during operation.

Referring again to FIG. 1, process 100 can generate printed images with a lower gloss level (block 108) based on the identified gloss level in the print job data. In the printer 10, process 100 generates ink images with decreased gloss levels by heating the print medium 49 to a lower temperature prior to transfixing the ink image (block 128), heating the imaging member to a lower temperature (block 132), transfixing the ink image to the media sheet at a high speed (block 136), applying a comparatively larger volume of release agent to the imaging member during a transfixing operation (block 140), and by transferring the printed media page through the nip a second time to engage the transfix roller 19 to the printed image on the print medium 49 (block 144).

In the processing of block 128, the printer 10 activates the pre-heater assembly 52 to heat the print medium 49 to an elevated temperature before the print medium 49 passes through the transfix nip 18. The heater 52 heats the print medium 49 to an elevated temperature that is less than the elevated temperature identified in the processing described with reference to block 112 above. The heater 52 heats the print medium 49 to a temperature that enables the ink image formed on the imaging member 12 to be transferred to the print medium 49, and to have the phase change ink cool and solidify more quickly than in the high gloss level operating mode. The lower temperature enables the liquid ink to solidify with rougher surface that reflects light in a more diffuse manner, resulting in a decreased gloss level of the printed image. In the embodiment of printer 10, the elevated temperature of the print medium is approximately 50° C.

In the processing described with reference to block 132, the printer 10 activates the imaging member heater 54 to heat the image receiving surface 14 to an elevated temperature prior to forming an ink image on the image receiving surface 14. The heater 52 heats the image receiving surface 14 to an elevated temperature that is lower than the elevated temperature identified in the processing described above with reference to block 116. The image receiving surface 14 is heated to a temperature than enables the ink image to be transferred to the print medium with a reduced gloss level. The lower temperature ink drops spread to a lesser degree on the print medium 49 during the transfix process and form a less uniform surface that reflects light in a diffuse manner, resulting in a decreased gloss level of the printed image. In the embodiment of printer 10, the image receiving surface 14 is heated to approximately 55° C. in a low gloss print mode. Both the heating of the print medium 49 described above and the heating of the imaging receiving surface 14 enable the phase change ink to cool and solidify in a shorter period of time during and after the transfixing process to produce a solid ink image with a rougher surface and lower gloss level.

In the processing described above with reference to block 136, the printer 10 rotates the imaging member 12 at a higher rate as the print medium 49 passes through the transfix nip 18 to transfer the ink image onto the print medium 49 with a higher gloss level. In the printer 10, the linear speed of the image receiving surface 14 is approximately 20 inches per second (IPS) as the print medium 49 passes through the transfix nip 18. At a higher transfixing speed, the print medium 49 spends comparatively less time in the transfix nip 18. The decreased time in the transfix nip 18 enables the ink image transferred from the image receiving surface 14 to transfer to the print medium 49 more quickly with less time to spread the ink drop on the print medium and producing a rougher surface on the ink image that reflects light in a diffuse manner for a lower gloss level.

In the processing described with reference to block 140, the printer 10 applies a comparatively larger volume of release agent to the image receiving surface 14. The printer 10 rotates the imaging member 12 at a rate that is greater than the rate identified in the processing described above with reference to block 124 and the maintenance unit 36 applies a greater volume of the release agent to the image receiving surface 14. As described above with reference to process 200, the controller 80 can adjust the rotational rate of the imaging member 12 with reference to the operational age of the maintenance unit 36 and metering blade 38 to apply a selected volume of release agent to the image receiving surface 14. In the printer 10, the image receiving surface 14 moves at a linear velocity of approximately 80 IPS to receive a greater volume of release agent from the maintenance unit 36.

In the processing of block 144, the print medium 49 moves through the duplex media path P' and returns to the transfix nip 18 after the ink image is transfixed to the first side of the print medium 49. The duplex media path P' orients the printed side of the print medium 49 to engage the transfix roller 19 instead of the imaging member 12. In a simplex print mode, the imaging member 12 does not transfer an ink image to the second side of the print medium 49. The surface of the transfix roller 19 engages the printed ink image. In the printer the surface of the transfix roller is textured and the surface of the transfix roller 19 applies pressure to the ink image on the print medium 49 as the print medium 49 passes through the transfix nip 18. The engagement with the transfix roller 19 increases the roughness and reduces the gloss level of the ink image.

As described above, the textured surface of the transfix roller 19 reduces the gloss level of the printed image. In the printer 10, a portion of the transfer agent on the image receiving surface 14 can transfer to the transfix roller 19 when the imaging member 12 rotates while engaged to the transfix roller 19 prior to the print medium 49 entering the transfix nip 18. When the transfix roller 19 subsequently engages the printed image on the printed medium 49, the release agent on the transfix roller tends to reduce the effectiveness of the transfix roller 19 in reducing the gloss level of the printed image. For example, in the printer 10, passing the printed side of a simplex printed sheet through the duplex media path P' and through the transfix nip generates a reduction of approximately 5 to 10 GUs when release agent covers the transfix roller.

Process 100 optionally removes the transfix roller 19 from engagement with the imaging drum when a print medium is not present in the transfix nip 18 to reduce or eliminate the transfer of release agent to the transfix roller 19 (block 148). In the printer 10, the transfix roller position actuator 13 moves the transfix roller in direction 15 to remove the transfix roller from engagement with the imaging member 12. The imaging member 12 rotates in direction 16 to receive release agent from the maintenance unit 16 and to receive ink drops that form a latent ink image from the printhead units 32 and 34. Once the latent ink images are formed on the image receiving surface 14, the rotation of the imaging member 12 halts and the media path 50 moves a leading edge of the print medium 49 into a position between the transfix roller 19 and the imaging member 12. The transfix roller position actuator 13 moves the transfix roller 19 into engagement with the imaging member 12 through the print medium 49, which is already in the transfix nip 18. The imaging member 12 resumes rotation in direction 16 to transfer the ink image to the print medium 49 and the movement of the imaging member 12 advances the print medium through the transfix nip 18 in the process direction P.

After the ink image is transfixed to the print medium 49 and prior to the print medium 49 exiting the nip, the imaging member 12 halts and the transfix roller position actuator 13 moves the transfix roller 190 out of engagement with the imaging member 12. The printer 10 disengages the transfix roller 19 from the imaging member 12 in a similar manner when no print medium is present in the transfix nip 18. Thus, the transfix roller 19 does not directly engage the image receiving surface 14 and release agent from the image receiving surface 14 does not transfer to the transfix roller. In a subsequent duplex pass, the bare transfix roller 19 engages the printed ink image on the first side of the media sheet and reduces the gloss level of the printed ink image by an additional 5 to 10 GU.

Figure 3:
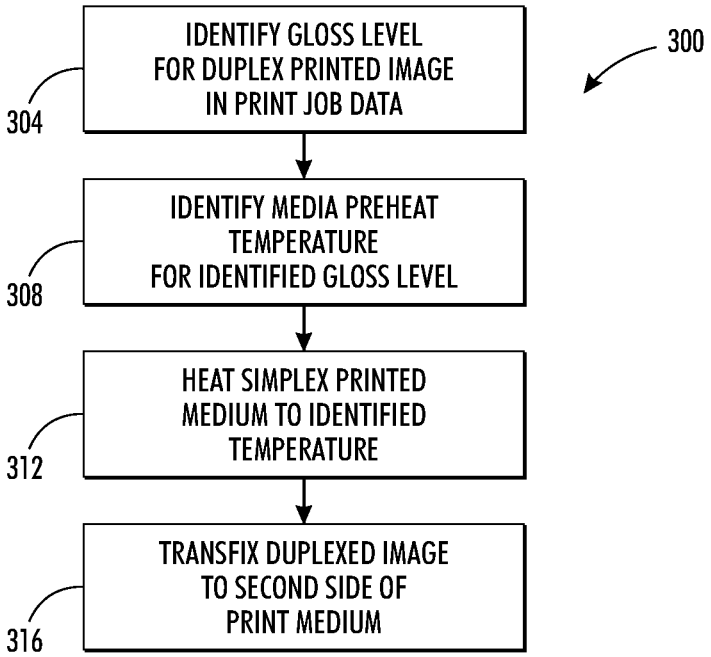
FIG. 3 is a block diagram of a process 300 for controlling a gloss level of a duplex printed image in an inkjet printer.

FIG. 3 depicts a process 300 for adjusting the gloss level of a duplex printed image. In a duplex print mode, a first ink image is printed on one side of a print medium and the printer subsequently forms a second ink image on the second side of the print medium. In the discussion below, a reference to the process 300 performing a function or action refers to a controller executing programmed instructions stored in a memory to operate one or more components of the printer to perform the function or action. Process 300 enables a printer to select a gloss level for the second ink image without substantially affecting the gloss level of the previously printed first ink image. In the printer 10 the controller 80 executes programmed instructions stored in the memory 84 to process print job data and control the subsystems in the printer 10 to generate duplex printed images with different gloss levels.

Process 300 begins by identifying a gloss level for the duplex printed image in the print job data (block 304). As described above, the print job data can include a parameter that specifies a numeric gloss level for the printed image, or the printer 10 can identify a gloss level indirectly with reference to one or more print job parameters. In some print jobs, the gloss level identified in the print job data for the first ink image printed on a print medium 49 differs from the gloss level identified for the second ink image.

Figure 4:
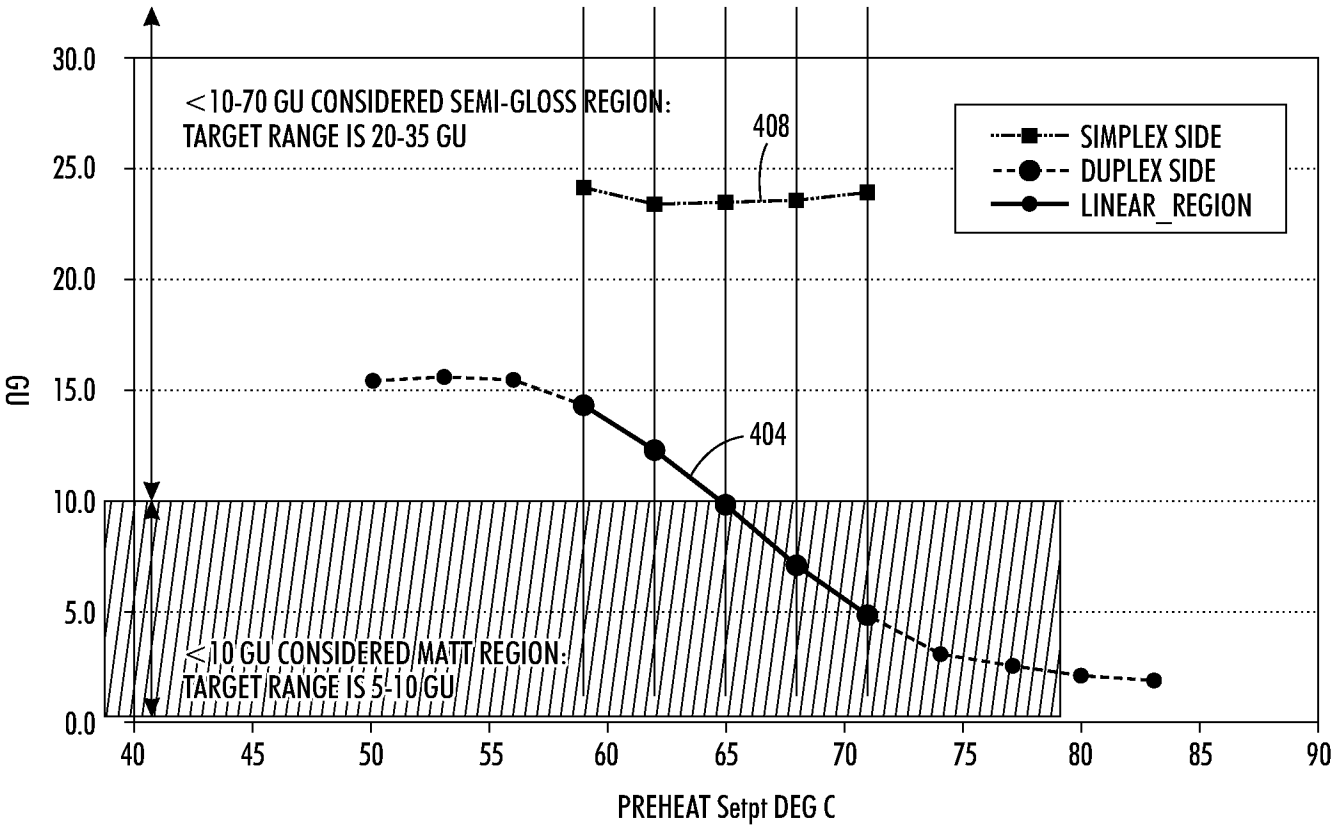
FIG. 4 is a graph depicting a relationship between a temperature of a print medium in a duplex print mode prior to printing a duplex ink image and a gloss level of ink formed in the duplex ink image.

Once the gloss level for the duplex printed image is identified, process 300 identifies a temperature for heating the print medium 49 prior to transfixing the duplex image (block 308). FIG. 4 depicts a graph 404 of the gloss level of duplex images over a range of temperatures for the print medium 49 and a graph 408 of the gloss level of simplex images on the print medium 49 during the duplex imaging operation. In the phase change printer 10, the gloss level for the duplex ink image is inversely proportional to the temperature of the print medium in a twelve degree temperature range between approximately 58° C. and 70° C. The gloss level decreases approximately linearly from a maximum of 15 GU at 58° C. to a minimum of approximately 5 GU at 70° C. While the temperature of the print medium affects the gloss level of the duplex printed image, the simplex printed image, depicted in graph 408, varies minimally with the selected temperature of the print medium. Consequently, process 300 identifies a temperature to heat the print medium with reference to the identified gloss level of the duplex image without substantially affecting the gloss level of previously printed simplex image.

Referring again to FIG. 3, process 300 heats the print medium to the identified temperature (block 312) and transfixes the duplex ink image onto the second side of the print medium (block 316). In the printer 10, the pre-heater assembly 52 heats the print medium 49 to the identified temperature as the print medium 49 approaches the transfix nip 18. The media transport 50 moves the print medium 49 to the transfix nip 18, and the duplex ink image is transfixed from the imaging member 12 to the second side of the print medium 49.

The processes 100 and 300 described above can be used individually and in combination in various printer embodiments. For example, the printer 10 performs process 100 to control the gloss level of images formed during simplex imaging operations and during first-side printing in duplex imaging operations. The printer 10 also performs process 300 to control the gloss levels of second-side images formed during duplex printing operations. The printer 10 performs process 100 in combination with process 300 for duplex printed images to further adjust the gloss level of the duplex printed image. Alternative printer embodiments implement some or all of the foregoing operations to adjust the gloss level of printed images.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of changing a gloss level of a printed image produced by a printer comprising:

operating a plurality of inkjets with a controller to eject a plurality of ink drops onto a surface of an imaging member to form an ink image on the imaging member;

operate a media path to move a print medium through a nip formed between the imaging member and a transfix member to transfer the ink image from the imaging member onto one side of the print medium; and operate the media path to move the print medium through the nip after the ink image has been transferred to the print medium to reduce a gloss level of the printed image by engaging the one side of the print medium having the ink image with the transfix member while engaging another side of the print medium not having an ink image with the imaging member.

2. The method of claim 1, the moving of the print medium with the media path by the controller to reduce the gloss level further comprising:

operating an actuator with the controller to separate the imaging member and the transfix member after transferring the ink image to the print medium and prior to the print medium moving through the nip to reduce the gloss level;

operating the actuator with the controller to move the transfix member to contact the imaging member to form the nip before moving the print medium through the nip to reduce the gloss level.

3. The method of claim 1 further comprising:

applying a first volume of a release agent or a second volume of the release agent to the imaging member with the controller prior to forming the ink image on the imaging member, the first volume being greater than the second volume, the first volume of release agent generating the printed image with a first gloss level and the second volume of release agent generating the printed image with a second gloss level, the first gloss level being less than the second gloss level.

4. The method of claim 3 wherein the controller operates the actuator to move the imaging member at a first rotational speed for application of the first volume of the release agent and at a second rotational speed for application of the second volume of the release agent, the first rotational speed being greater than the second rotational speed.

5. The method of claim 4 further comprising:

identifying with the controller an operational age of a maintenance unit that applies the release agent to the imaging member; and operating the actuator with the controller to adjust the first rotational speed of the imaging member and the second rotational speed of the imaging member with reference to the identified operational age of the maintenance unit.

6. The method of claim 1 further comprising:

operating the actuator with the controller to move the imaging member at a first rotational speed or a second rotational speed when moving the print medium through the nip to transfer the ink image, the first rotational speed being greater than the second rotational speed, the first rotational speed generating the printed image with a first gloss level and the second rotational speed generating the printed image with a second gloss level, the first gloss level being less than the second gloss level.

7. The method of claim 1 further comprising:

operating a heater with the controller to heat the imaging member to a first temperature or a second temperature prior to moving the media sheet through the nip to transfer the ink image, the first temperature being greater than the second temperature, the first temperature generating the printed image with a first gloss level and the second temperature generating the printed image with a second gloss level, the first gloss level being greater than the second gloss level.

8. A printer comprising:

a plurality of inkjets configured to eject ink drops onto an imaging member;

an actuator operatively connected to the imaging member to rotate the imaging member;

a transfix member configured to move into and out of engagement with the imaging member to form a nip;

a media path configured to move a print medium through the nip; and a controller operatively connected to the plurality of inkjets, the actuator, and the media path, the controller being configured to:

operate the actuator to rotate the imaging member;

eject a plurality of ink drops onto the imaging member with the plurality of inkjets to form an ink image on the imaging member;

operate the media path to move the print medium through the nip to transfer the ink image from the imaging member onto a first side of the print medium; and operate the media path to move the print medium through the nip to to reduce a gloss level of the ink image by engaging the ink image with the transfix member and engaging a second side of the print medium having no ink image with the imaging member.

9. The printer of claim 8, the controller being further configured to:

apply a first volume of a release agent or a second volume of the release agent to the imaging member prior to forming the ink image on the imaging member, the first volume being greater than the second volume, the first volume of release agent generating the printed image with a first gloss level and the second volume of release agent generating the printed image with a second gloss level, the first gloss level being less than the second gloss level.

10. The printer of claim 9, the controller being further configured to:

operate the actuator to move the imaging member at a first rotational speed for application of the first volume of the release agent and to move the imaging member at a second rotational speed for application of the second volume of the release agent, the first rotational speed being greater than the second rotational speed.

11. The printer of claim 10, the controller being further configured to:

identify an operational age of a maintenance unit that applies the release agent to the imaging member; and operate the actuator to adjust the first rotational speed of the imaging member and the second rotational speed of the imaging member with reference to the identified operational age of the maintenance unit.

12. The printer of claim 8, the controller being further configured to:

operate the actuator to move the imaging member at a first rotational speed or a second rotational speed when moving the print medium through the nip to transfer the ink image, the first rotational speed being greater than the second rotational speed, the first rotational speed generating the printed image with a first gloss level and the second rotational speed generating the printed image with a second gloss level, the first gloss level being less than the second gloss level.

* * * * *